United States Patent [19]

Daussan et al.

[11] 4,368,834

[45] Jan. 18, 1983

[54] PREHEATING DEVICE FOR STOPPER-TYPE TUNDISHES

[75] Inventors: Jean-Charles Daussan; Gérard Daussan, both of Metz; André Daussan, Longeville-les-Metz, all of France

[73] Assignee: Daussan et Compagnie, Woippy, France

[21] Appl. No.: 839,286

[22] Filed: Oct. 3, 1977

[30] Foreign Application Priority Data

Oct. 14, 1976 [FR] France ..... 76 30912

[51] Int. Cl.[3] ..... B22D 41/10

[52] U.S. Cl. ..... 222/593; 222/602; 222/597; 164/134

[58] Field of Search ..... 266/236, 238, 271, 45; 164/134, 148, 152, 33, 335, 337, 437, 438; 222/146 H, 592, 593, 602, 564, 597

[56] References Cited

U.S. PATENT DOCUMENTS

| | | | |
|---|---|---|---|
| 3,006,046 | 10/1961 | Shephard, Jr. et al. | 266/281 X |
| 3,382,913 | 5/1968 | Michelson | 164/438 X |
| 3,934,755 | 1/1976 | Rheinlauder et al. | 164/134 X |

FOREIGN PATENT DOCUMENTS

| | | | |
|---|---|---|---|
| 45-15482 | 5/1970 | Japan | 222/602 |
| 49-48044 | 12/1974 | Japan | 164/337 |
| 51-22626 | 2/1976 | Japan | 222/593 |
| 1364665 | 8/1974 | United Kingdom | 222/607 |

OTHER PUBLICATIONS

American Metal Market; *New Liner for Tundish Developed by Foseco:* 7/21/70, No. 138.

Babcock & Wilcox, Kaowool® Ceramic Fiber Products–Vacuum Formed Shapes, 12-1-70.

*Primary Examiner*—David A. Scherbel

*Attorney, Agent, or Firm*—Young & Thompson

[57] ABSTRACT

A tundish provided with at least one stopper which moves towards or away from a casting outlet formed in the bottom tundish wall and with a burner placed in the vicinity of the outlet essentially comprises at least one casing which is placed around the casting outlet in such a manner as to surround the stopper at least to a partial extent and which can be put into communication with the burner.

5 Claims, 6 Drawing Figures

PREHEATING DEVICE FOR STOPPER-TYPE TUNDISHES

This invention relates to a preheating device for vessels which serve to transfer metals, more especially for casting distributors or tundishes of the type comprising at least one plug or stopper which is often designated by steelmakers as a "stopper-rod" and is capable of moving towards a casting outlet formed in the bottom wall of the tundish.

The invention is directed primarily, although not in any limiting sense, to tundishes which are lined internally with plates of heat-insulating material. These heat-insulating plates make it possible to limit the number of tundishes which are necessary in order to carry out a predetermined production cycle, to facilitate stripping of molds while preventing the solidified metal from becoming attached to the walls of the tundish and to prevent premature wear of the subjacent refractory lining. Furthermore, these heat-insulating plates make it possible to dispense with preheating of the refractory lining prior to casting. The advantage just mentioned is the most decisive by reason of the substantial economy and considerable saving of time thus achieved.

It is not possible, however, to dispense with preheating in all cases. In fact, when the tundish is employed especially for the purpose of casting blooms, it must necessarily be equipped with stopper-rods and nozzles in order to permit stoppage of the casting operation.

Under these conditions it is essential to preheat the stoppers and nozzles before pouring the liquid metal into the tundish in order to prevent any solidification of the metal which is in contact with the stoppers since this would have the effect of interfering with the operation of these latter or even of obstructing the casting outlets.

This preheating operation is performed by placing the flame of a burner or torch beneath and/or over the casting outlet which is adjacent to the stopper. This preheating operation is of long duration and cannot be carried out to the full extent without destroying the heat-insulating plates which are adjacent to the casting outlet. In consequence, the stoppers are usually heated to an insufficient extent. In order to overcome this disadvantage, the beginning of the casting operation is carried out at high speed in order to prevent the metal from having time to solidify in contact with the stoppers and obstructing the casting outlet of the tundish. A high casting speed of this order, however, often results in overflow which is liable to be very dangerous for personnel stationed in the casting area.

The aim of the invention is to overcome the above-mentioned disadvantages by means of a device which provides effective and reliable preheating and makes it possible in particular to prevent any solidification of metal in contact with stoppers and duct walls.

In accordance with the invention, the preheating device for a tundish comprising at least one stopper which is capable of moving towards a casting outlet formed in the bottom wall of the tundish, heating means being intended to be placed beneath and/or over said outlet, essentially comprises at least one casing which is placed around the casting outlet in such a manner as to surround the stopper at least to a partial extent and which can be put into communication with the heating means.

The casing aforesaid makes it possible to obtain at the time of preheating a rapid progression of the temperature in the vicinity of the stopper and the casting outlet without thereby subjecting the heat-insulating lining of the tundish to any degradation.

Moreover, the casing which surrounds the stopper and the casting outlet prevents cooling of these latter after stopping the preheating operation. Provision can also be made for an additional casing which surrounds the lower portion of the casting outlet, especially when said outlet has an extension in the form of a nozzle of substantial length or so-called immersion nozzle. The metal can thus be poured without any attendant danger of solidification of the metal at the level of the stopper and of the casting outlet and without making it necessary to carry out the beginning of the casting operation at high speed.

In accordance with an advantageous embodiment of the invention, the casing is provided in the wall opposite to the casting outlet with an opening which forms a passageway for the stopper, the clearance space between said opening and said stopper being sufficient to permit the flow of the combustion gases emitted by a retractable burner placed beneath the casting outlet which can also be heat-insulated by means of a lower casing.

In accordance with a preferred embodiment of the invention, the material constituting the casing or casings is selected from exothermic or sinterable refractory heat-insulating materials.

By virtue of these materials, a temperature of the order of 1300° C. can be very rapidly attained within the casings, thus ensuring wholly sufficient heating of the casting outlet, of the stopper and of the casting nozzle. Furthermore, by reason of the heat insulation provided by the casing or casings, it is possible to employ a single burner of the propane type, for example, for the preheating operation.

Further distinctive features and advantages of the invention will become apparent from the following description, reference being made to the accompanying drawings which are given by way of example without any limitation being implied, and in which.

Figure 1:
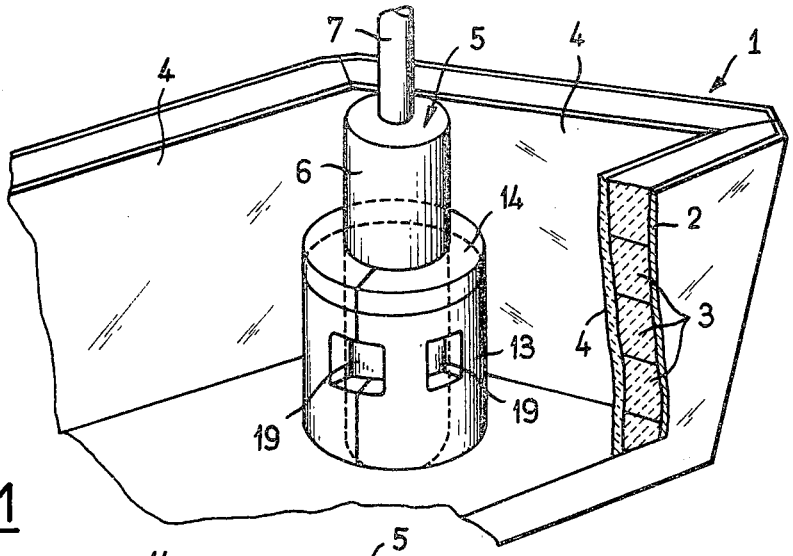
FIG. 1 is a fragmentary view in perspective showing a preheating device in accordance with the invention, said device being mounted in a tundish.
Figure 2:
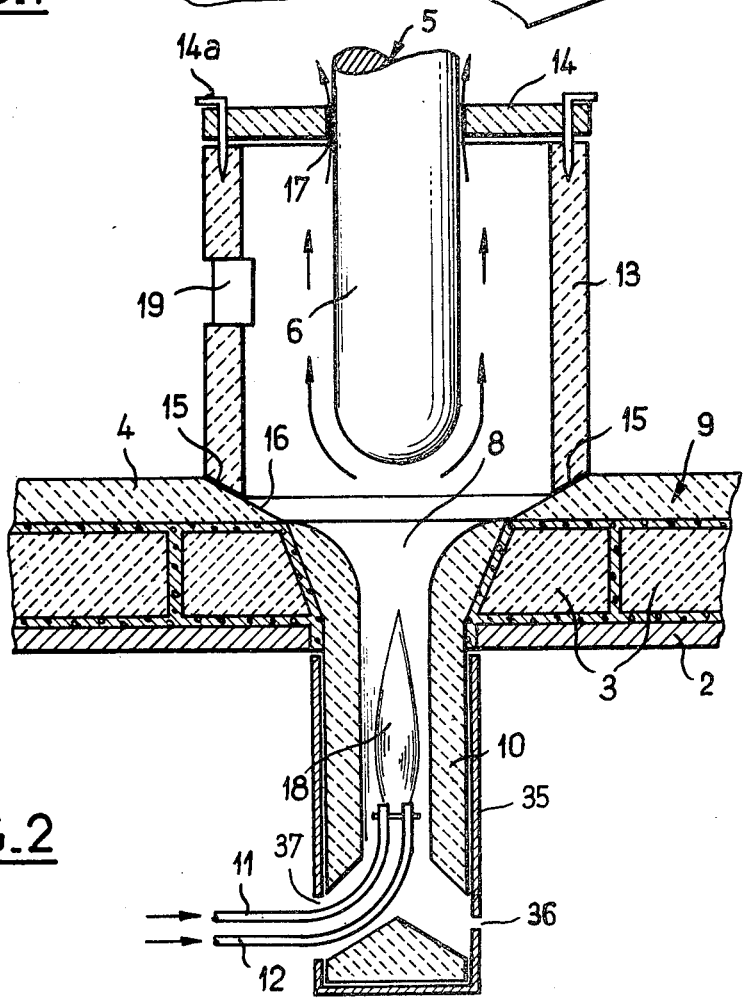
FIG. 2 is a longitudinal sectional view to a larger scale and showing the device of FIG. 1.

In the embodiments illustrated in FIGS. 1 and 2, the tundish 1 has an outer casing 2 of metal, an intermediate packing of refractory bricks 3 and an inner lining constituted by detachable plates 4 of heat-insulating material. This heat-insulating material can be fabricated for example from a mixture of refractory inorganic particles and mineral, vegetable and/or inorganic mineral fibers formed by means of melting baths of silicates of calcium, aluminum and other di- or trivalent metals comprising the rock wools, mineral wools or slag wools, and glass wool or the high melting-point fibers, the ceramic fibers and in particular the highly refractory fibers which are wholly constituted by alumina and silica or primarily constituted by alumina and silica to which are added oxides such as titanium or zirconium oxide, or the fibers of borosilicates, or the fibers of substantially pure silica. These fibers are coated between each other with an organic and/or inorganic binder.

The tundish 1 comprises a stopper-rod unit 5 which is provided with a rounded head 6 at the free end of said unit and is rigidly fixed to a rod 7. Said head 6 is of refractory material, graphite or any other material which affords resistance to the temperature of the molten metal. The rod 7 is connected to means (not shown in the drawings) for moving the stopper 5 towards the casting outlet 8 formed in the bottom wall 9 of the tundish 1 in order to stop the flow of metal through the casting outlet 8. Said outlet opens to the exterior of the tundish 1 through a casting nozzle 10 of refractory material.

Within said casting nozzle 10 are engaged the pipes 11 and 12 for the supply of air and combustible gas (propane, for example) to a retractable burner.

In accordance with the invention, the device for preheating the tundish 1 comprises a casing placed around the casting outlet 8 and adapted to surround the head 6 of the stopper 5 to at least a partial extent. In the example shown in FIGS. 1 and 2, said casing is constituted by a sleeve 13 fitted with a cover-plate 14, the space formed between said sleeve 13 and the head 6 of the stopper 5 being intended to constitute a chamber for the storage of heat emitted by the burner.

That end 15 of the sleeve 13 which is adjacent to the outlet 8 is chamfered in order to improve the positioning of the sleeve 13 on the complementary frusto-conical recess 16 formed on the insulating plate 4 which is placed on the bottom wall 9 of the tundish. The cover-plate 14 can be secured to the sleeve 13 by means of nails **14*a* or the like. The lower casing 35 surrounds the entire lower end of the nozzle 10 and has an opening 37 in order to permit the introduction of the burner 11/12. Said casing can be provided with an orifice 36** which forms an additional passage for burnt gases.

The material constituting the sleeve 13, its cover-plate 14 as well as the sleeve 35 is preferably chosen from the following compositions which are given by way of example:

EXAMPLE 1

Exothermic composition

| | |
|---|---|
| Silica: | 42% by weight |
| Alumina: | 11 % by weight |
| Ferrous oxide: | 3 % by weight |
| Aluminum: | 22 % by weight |
| Fluorspar or sodium fluoride: | 2.5% by weight |
| Manganese: | 4.5% by weight |
| Ignition loss: | complement to 100% |

EXAMPLE 2

Refractory heat-insulating composition

| | |
|---|---|
| Mineral fibers (rock wool, glass wool, silico-aluminous wool: melting-point higher than 1700° C.): | 70 to 97% by weight |
| Binder (organic and/or inorganic, refractory cement): | 0.5 to 0.8% by weight |
| Refractory charge of acid and/or basic inorganic particles: | 0 to 20% by weight |

EXAMPLE 3

Sinterable or non-sinterable heat-insulating composition

| | |
|---|---|
| Refractory charge of acid and/or basic inorganic particles (silica, alumina): | 50 to 95% by weight |
| Organic binder (phenolic resin) and/or inorganic binder (cement): | 0.5 to 20% by weight |
| Fluxes (alkali or alkaline-earth oxides): | 0 to 20% by weight |
| Mineral and/or organic fibers: | 0 to 50% by weight |

EXAMPLE 4

Refractory heat-insulating composition having a base of silica and/or aluminosilicate and/or chamotte which may or may not receive additions of sawdust, diatomaceous earths and high-temperature agglomerates in accordance with the principle of manufacture of ordinary refractories, namely which consists in the more or less complete conversion of quartz to cristobalite or tridymites in the case of silica and clay to mullite in the case of the aluminosilicates and the chamottes. These products can also be chemically bonded in the cold state.

It is further apparent from FIGS. 1 and 2 that the cover-plate 14 of the sleeve 13 has an axial opening 17 for the insertion of the stopper head 6. The clearance space formed between said opening 17 and the stopper head 6 is sufficient to provide a passageway for the combustion gases emitted by the flame 18 of the burner which is placed beneath the nozzle 10.

The sleeve 13 is provided in addition with a series of lateral openings 19 which are located in spaced relation substantially at mid-height around the periphery of the sleeve 13.

The internal diameter of the sleeve 13 is preferably two to three times larger than the diameter of the head 6 of the stopper 5. By way of example, the sleeve 13 can thus have an internal diameter of 25 cm and a height of 30 cm in the case of a stopper in which the head 6 has a diameter within the range of 10 to 15 cm.

It is also preferable to ensure that the sleeve 13 is constituted by two juxtaposed half-shells and that the cover-plate 14 of said sleeve is designed in two parts as shown in FIG. 1 in order to facilitate positioning of said sleeve 13 and its cover-plate 14 around the head 6 of the stopper 5.

The operation of the preheating device described with reference to FIGS. 1 and 2 is as follows:

Before pouring liquid metal into the tundish 1, a burner of the propane type, for example, is engaged within the nozzle 10. The flame 18 produced by said burner heats the nozzle 10 as well as the space formed between the sleeve 13 and the head 6 of the stopper 5.

The smoke produced by the combustion escapes through the clearance space formed between the opening 17 of the cover-plate 14 of the head 6 of the stopper 5 and the orifice 36. By virtue of the heat insulation provided by the sleeve 13, the cover-plate 14 and the sleeve 35, the temperature rises very rapidly in the vicinity of the head 6 of the casting outlet 8 and of the nozzle 10.

Thus a temperature of 1300° C. is attained at this point in less than 20 minutes by making use of a simple propane burner. The material which forms the sleeve 13, the cover-plate 14 and the sleeve 35 corresponds to one of the examples given in the foregoing.

A preheating temperature of this order is amply sufficient to prevent any solidification of the liquid metal in contact with the head 6 of the stopper 5 and with the nozzle 10.

Moreover, the sleeve 13 has the effect of protecting the insulating plates 4 which are adjacent to the outlet 8 against any degradation which might otherwise result from preheating of extended duration.

When the preheating is sufficient, the burner is withdrawn. By virtue of the heat insulation provided by the sleeve 13, its cover-plate 14 and the sleeve 35, the head 6 of the stopper 5, the casting outlet 8 and the nozzle 35 are maintained at a temperature in the vicinity of 1300° C. during a sufficient period of time to permit the casting operation. At the time of filling of the tundish with liquid metal, this latter flows into the casting outlet 8 only when it has reached the level of the lateral openings 19 of the sleeve 13. This accordingly has the effect of preventing the first fraction of metal which has cooled in contact with the tundish plates 4 from solidifying at the level of the casting outlet 8 and obstructing this latter.

The casting operation can thus be initially performed at a low rate, thus removing any potential danger of overflow of the mold or of the ingot-mold which is placed beneath the nozzle 10.

Figure 4:
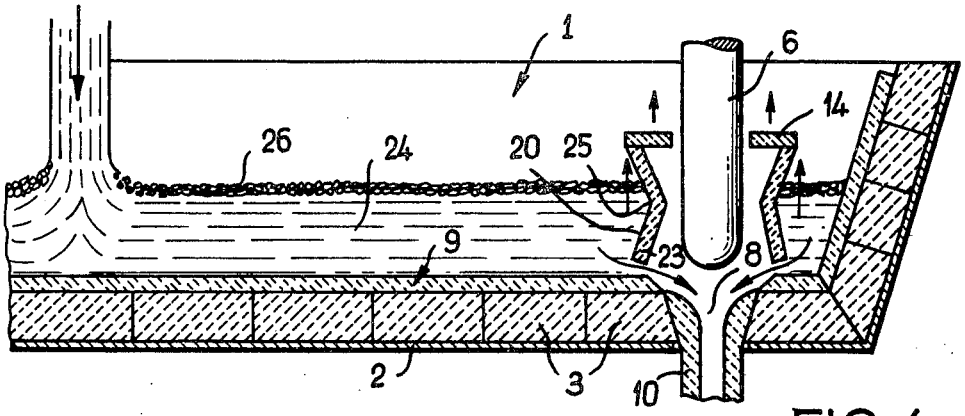
FIG. 4 is a fragmentary longitudinal sectional view to a smaller scale and showing a tundish equipped with the device of FIG. 3, during the final stage of filling of the tundish.
Figure 3:
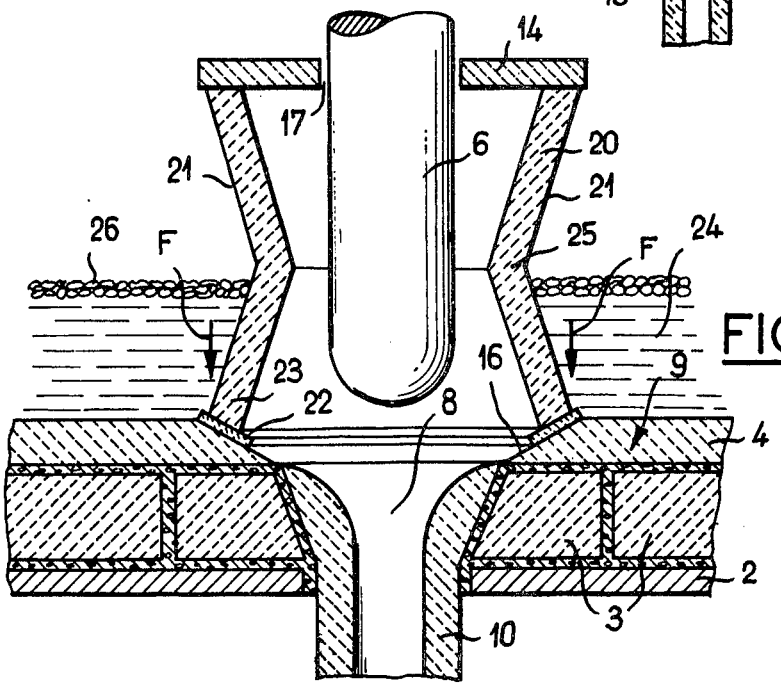
FIG. 3 is a longitudinal sectional view of an alternative embodiment of the device in accordance with the invention during the preliminary stage of filling of the tundish without heat-insulation of the lower portion of the nozzle.

In the embodiment of FIG. 3, the wall of the sleeve 20 has a concave outer surface 21, namely a surface which is constricted at or near the center of said sleeve 20. It can also be noted that said sleeve is no longer provided with lateral openings. Furthermore, a seal 22 of refractory material can be inserted between the bottom end 23 of said sleeve and the frusto-conical recess 16 of the insulating plate 4 which is adjacent to the casting outlet 8. The technical effects of the sleeve 20 are as follows:

During the initial stage of filling of the tundish with molten metal 24, that is, before this molten metal has reached the level of maximum constriction or throat 25 of the sleeve 20, the pressure of the metal has the effect of forcibly applying the lower end 23 of the sleeve 20 against the bottom wall 9 of the tundish (see arrow F). This effect is obtained by virtue of the fact that the lower end 23 of the sleeve 20 is flared-out towards the bottom wall 9. Thus no leakage of metal is liable to take place between the lower end 23 and the bottom wall 9. At the time of a subsequent stage of filling of the tundish with molten metal 24 and especially when the level of the metal rises above the throat 25 of the sleeve 20, this latter moves upwards under the action of Archimedean thrust (as shown in FIG. 4), with the result that the molten metal 24 flows between the lower end 23 of the sleeve 20 and the bottom wall 9 of the tundish.

This arrangement consequently makes it possible in addition to prevent cold metal from flowing directly into the casting outlet 8 and solidifying within this latter. Furthermore, the sleeve 20 prevents the slag 26 which is present at the surface of the metal from penetrating into the casting outlet 8 from obstructing this latter and contaminating the cast metal.

Figure 5:
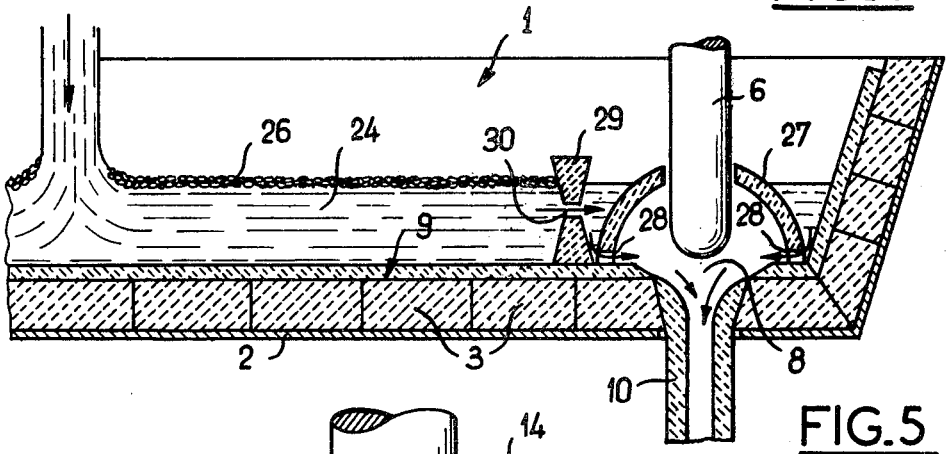
FIG. 5 is a view which is similar to that of FIG. 4, the casting distributor being equipped with another alternative embodiment of the device in accordance with the invention.

In the embodiment of FIG. 5, the preheating device comprises a bell-shaped casing 27, the open portion of which is placed around the casting outlet 8.

Furthermore, said bell-casing 27 is provided with lateral openings constituted by slits 28 formed in that edge of said casing which is placed around the casting outlet 8.

The bell-casing 27 is associated with a barrier plate 29 which is mounted on the bottom wall 9 of the tundish 1 upstream of the bell-casing 27 with respect to the direction of flow of the metal 24 along said bottom wall 9. Said barrier plate 29 is provided with an opening 30 which is formed substantially at the mid-height of this latter.

The barrier plate 29 makes it possible to prevent metal which has cooled in contact with the bottom wall 9 of the tundish 1 from flowing directly into the casting outlet 8 through the slits 28 formed in the bottom portion of the bell-casing 27 and thus carrying the slag 26 through said outlet 8. The metal 24 in fact reaches the casting outlet 8 only when it has come up to the level of the opening 30 formed in the barrier plate 29. Thus the metal 24 which flows through said opening 30 is in the hot state and free from slag, thereby avoiding any potential danger of closure of the casting outlet and contamination of the cast metal.

Figure 6:
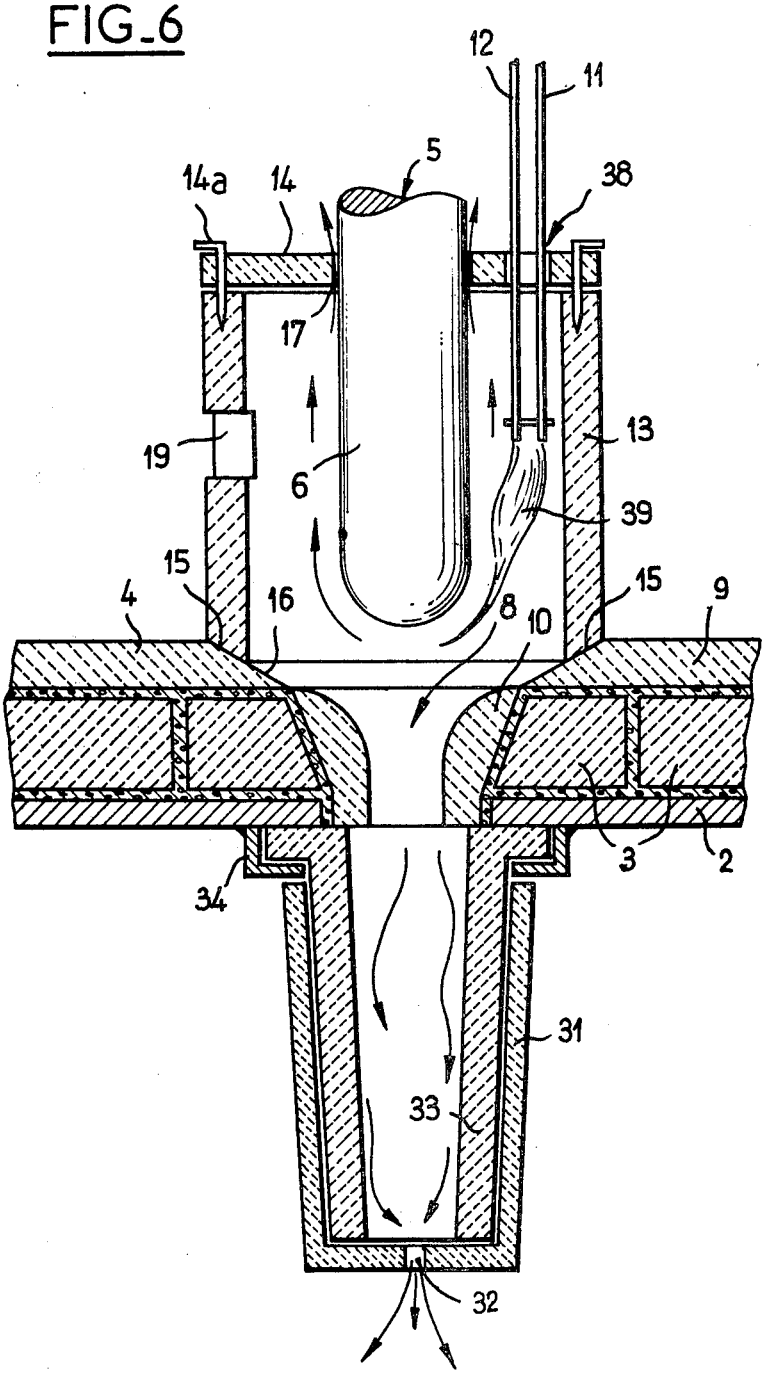
FIG. 6 is a longitudinal sectional view to a larger scale and showing an alternative embodiment of the device in accordance with the invention as shown in FIG. 1.

In the embodiment of FIG. 6, the operation of the preheating device is reversed with respect to the preheating device described with reference to FIGS. 1 and 2. Before pouring liquid metal into the tundish, a burner 11/12 is engaged within the orifice 38 of the cover-plate 14 of the sleeve 13. The flame 39 produced by said burner heats the space formed between the sleeve 13, the head 6 of the stopper 5, the nozzle 10 as well as the detachable nozzle 33 which is maintained in position by means of guides 34. The smoke produced by the combustion escapes through the space formed between the opening 17 of the cover-plate 14 of the head 6 of the stopper 5 and the narrow discharge aperture 32 of the sleeve 31.

By virtue of the heat insulation provided by the sleeve 13, the cover-plate 14 and the sleeve 31, the temperature rises very rapidly in the vicinity of the head 6, the casting outlet 8, the nozzle 10 and nozzle extension 33.

This preheating system can also be applied to the types of nozzle which are shown in FIG. 2. It is only necessary to provide two diametrically opposite orifices 36. The material of the sleeve 13, the cover-plate 14, the sleeve 31 and the detachable plates 4 corresponds to one of the examples mentioned in the foregoing.

The sleeves 35 and 31 shown in FIGS. 2 and 6 are conducive to heating of the nozzles over the entire length of these latter before they come into contact with the molten steel, thereby achieving a saving of preheating time and of heat. The nozzles are protected from thermal shock by the insulating sleeves which have both an insulating and protective function when they are placed in contact with the molten steel since the temperature of the steel is progressively imparted to the nozzles by virtue of said insulating sleeves.

By reason of the rational temperature distribution within the mass of the nozzles, clogging of the nozzle outlets is prevented by retention of heat.

Acid nozzles are endowed with resistance to basic attack by slag. Conversely, by manufacturing acid sleeves, the basic nozzles are endowed with resistance to acid attack by slags.

The sleeves, cover-plates and detachable plates are formed with or without vacuum by molding of ingredients on a filter from a dilute aqueous suspension. These devices can also be formed by immersing the cores fitted with filters in the highly dilute suspension of the material from which they are to be formed and by applying an internal vacuum for a period of time which varies according to the diameter of the sleeves.

We claim:

1. A preheating device for a tundish having a bottom wall and lateral walls and comprising at least one stopper which is capable of moving towards a casting outlet formed in said bottom wall, said casting outlet being formed with a casting nozzle extending outwardly from said bottom wall, said preheating device comprising a burner adapted to be introduced into said casting nozzle for preheating said casting outlet and said stopper, and a casing of refractory heat insulating material around the casting outlet so as to surround the free end of said stopper, said casing having a lateral wall comprising an upper end portion having an opening for the insertion of said stopper and a lower end portion which is flared-out towards the bottom wall of said tundish.

2. A preheating device according to claim 1, wherein the casing is substantially bell-shaped.

3. A preheating device according to claim 1, wherein said flared-out lower end portion of the lateral wall of said casing is prolonged by an upwardly flared-out upper end portion, said upper end portion being fitted with a cover-plate provided with said opening for the insertion of said stopper.

4. A preheating device according to claim 1, wherein said device further comprises a barrier plate extending between the lateral walls of said tundish and placed on said bottom wall of said tundish upstream of the casing with respect to the direction of flow of molten metal along said bottom wall, said barrier plate comprising at least an opening substantially at the mid-height of said barrier plate, said barrier plate preventing the flowing of the molten metal towards the casting outlet until the level of said molten metal has reached said opening of said barrier plate, said lower flared-out end portion by said casing comprising at least one lateral opening formed in the vicinity of the casting outlet.

5. A preheating device according to claim 4, wherein said casing is substantially bell-shaped.

* * * * *